US011549654B2

(12) United States Patent
Lee et al.

(10) Patent No.: US 11,549,654 B2
(45) Date of Patent: Jan. 10, 2023

(54) LIGHT GUIDE STRUCTURE WITH JAGGED PROTRUSIONS

(71) Applicant: TAN DE TECH CO., LTD., Douliu (TW)

(72) Inventors: Chao Pai Lee, Douliu (TW); Cheng Chih Lai, Douliu (TW); Chung Chiang Pan, Douliu (TW)

(73) Assignee: TAN DE TECH CO., LTD., Douliu (TW)

( * ) Notice: Subject to any disclaimer, the term of this patent is extended or adjusted under 35 U.S.C. 154(b) by 0 days.

(21) Appl. No.: 17/164,508

(22) Filed: Feb. 1, 2021

(65) Prior Publication Data

US 2022/0146069 A1 May 12, 2022

(30) Foreign Application Priority Data

Nov. 17, 2020 (TW) ..... 109140136

(51) Int. Cl.

| | |
|---|---|
| ***F21S 41/24*** | (2018.01) |
| ***F21S 41/143*** | (2018.01) |
| ***F21S 41/275*** | (2018.01) |
| *F21Y 115/10* | (2016.01) |

(52) U.S. Cl.

CPC ..... *F21S 41/24* (2018.01); *F21S 41/143* (2018.01); *F21S 41/275* (2018.01); *F21Y 2115/10* (2016.08)

(58) Field of Classification Search

CPC ..... F21S 41/275; F21S 41/24; F21S 41/143; F21S 41/265; G02B 6/0038

See application file for complete search history.

(56) References Cited

U.S. PATENT DOCUMENTS

| | | | | |
|---|---|---|---|---|
| 1,955,599 | A * | 4/1934 | Lamblin-Parent | F21V 5/045 359/743 |
| 3,708,221 | A * | 1/1973 | Schaefer | F21S 41/255 359/728 |
| 4,796,171 | A * | 1/1989 | Lindae | F21S 41/255 362/308 |
| 7,686,486 | B2 * | 3/2010 | Tessnow | F21S 41/321 362/487 |
| 9,429,292 | B2 * | 8/2016 | Choi | F21S 41/275 |

(Continued)

*Primary Examiner* — Rajarshi Chakraborty
*Assistant Examiner* — Michael Chiang
(74) *Attorney, Agent, or Firm* — Muncy, Geissler, Olds & Lowe, P.C.

(57) ABSTRACT

A light guide structure with jagged protrusions is configured in a lighting device of a mobile vehicle. The light guide structure includes a light injecting surface and a light emitting surface. The light emitting surface includes a middle section and two side sections deployed respectively at opposite ends of the middle section. The side sections have a plurality of jagged protrusions forming a light guiding area. The extending direction of the jagged protrusions intersects with the light emitting direction. A light source module forms an irradiation area by the light guide structure, the light guiding area extending the width of both sides of the irradiation area, the beam contour being enlarged evenly. The disclosure also provides a headlight structure, a light source module having the light guide structure and a convex lens configured sequentially in the light emitting direction.

12 Claims, 12 Drawing Sheets
(2 of 12 Drawing Sheet(s) Filed in Color)

(56) References Cited

U.S. PATENT DOCUMENTS

| | | | | |
|---|---|---|---|---|
| 9,803,821 | B2 * | 10/2017 | Iha | F21S 41/19 |
| 10,240,741 | B2 * | 3/2019 | Harrington, Jr. | F21S 41/255 |
| 2016/0252226 | A1 * | 9/2016 | Shih | F21S 43/243 362/511 |
| 2018/0335191 | A1 * | 11/2018 | Stefanov | F21S 41/635 |
| 2021/0231280 | A1 * | 7/2021 | Schreiber | G02B 3/0056 |
| 2021/0325016 | A1 * | 10/2021 | Moser | F21S 41/43 |

* cited by examiner

LIGHT GUIDE STRUCTURE WITH JAGGED PROTRUSIONS

BACKGROUND

Technical Field

The present disclosure is directed to a light guide structure with jagged protrusions for a headlight configured to adjust beam contour and partial luminance of low beam lights.

Related Art

LED headlight modules adjust beam contour and luminance distribution by light guides, lens, etc., in compliance with government regulations or to improve glare as a result of direct light.

SUMMARY

The present disclosure is directed to a light guide structure with jagged protrusions configured in a lighting device of a mobile vehicle. The light guide structure with jagged protrusions comprises a light injecting surface and a light emitting surface. The light emitting surface comprises a middle section and two side sections deployed respectively at opposite ends of the middle section. The side sections have a plurality of jagged protrusions forming a light guiding area. The extending direction of the jagged protrusions intersects with the light emitting direction. A light source module forms an irradiation area by the light guide structure, a light guiding area extending the width of both sides of the irradiation area, the beam contour being enlarged evenly.

In some embodiments, the extending direction of the jagged protrusions is vertical to the light emitting direction, the jagged protrusions having a cutting angle tilted from top to bottom outwardly.

In some embodiments, each of the side sections equals to average ⅓ the length of the light emitting surface in a longitudinal direction, the beam contour being enlarged evenly in a horizontal direction.

In some embodiments, the side sections comprise a smooth area and at least the light guiding area, the jagged protrusions being configured to the light guiding area to adjust corresponding beam contours.

In some embodiments, the middle section of the light emitting surface protrudes toward the light emitting direction, the beam contour being condensed to increase partial luminance.

In some embodiments, the middle section of the light emitting surface has the light guiding area neighboring a cutoff contour thereof, the light guiding area having a plurality of dentate protrusions, the extending direction of the dentate protrusions intersecting with the extending direction of the jagged protrusions, the beam contour being partially astigmatic, lowering the luminance to avoid affecting the vision of the oncoming driver. The middle section of the light guiding area is also geometrical contour, for instance, a plurality of dots, a polygonal plane matrix structure or a lattice matrix structure.

In some embodiments, the peripheral edge or the contour of the light emitting surface forms the light guiding area to improve the Blue field entoptic phenomenon of the beam contour.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

The following description is in accordance with common understanding of those skilled in the art. The light emitting direction (positive direction of X-axis) of headlights is referred as front. An irradiation area is referred to an illuminating area formed after the light source is reflected, refracted, or diffused by the light guide. The beam contour is referred to a light/dark border of the above-mentioned irradiation area.

Figure 12:
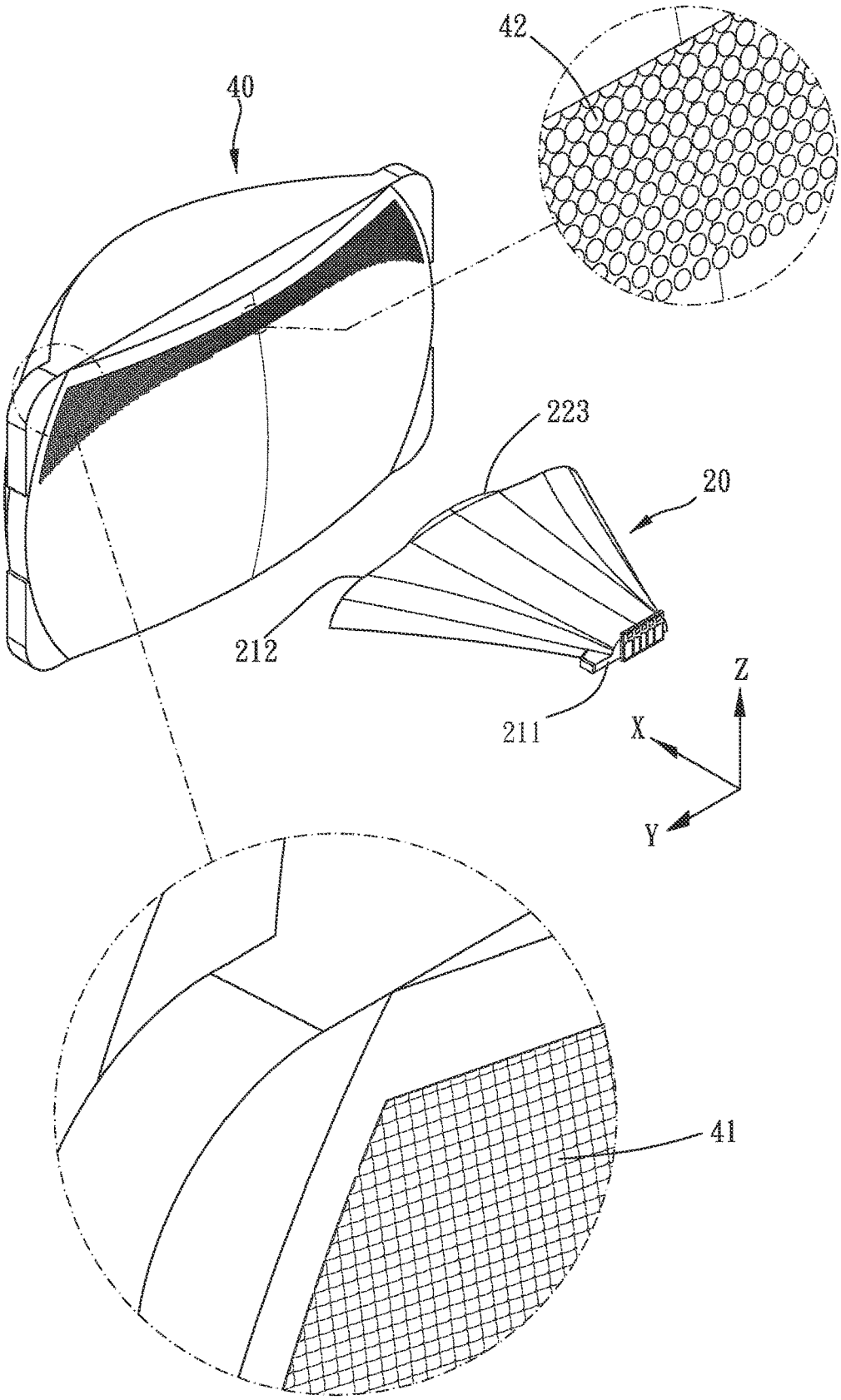
FIG. 12 is a schematic diagram showing an embodiment of a headlight structure and a partial enlarged view of the microstructure of the light emitting surface of the headlight lens.

Please refer to FIG. 1-FIG. 4, the instant disclosure provides an embodiment of a light guide structure with jagged protrusions configured in a lighting device of a mobile vehicle. The light guide structure with jagged protrusions comprises a light injecting surface 211 (as shown in FIG. 12) provided with a light source module 10 and a light emitting surface 212 (as shown in FIG. 12) facing a light emitting direction. A contour of the light emitting surface 212 of the light guide structure is used to define a beam contour projected by the light source module 10. Taking a view shown in FIG. 5 as an example, the contour of the light emitting surface 212 is roughly divided into a cutoff contour formed by two bevels and an upper contour (The contour of reference sign 22) having an arc contour. The upper contour and a lower contour are overlapped at both ends of the light emitting surface 212 forming the cutoff contour. In addition, the light emitting surface 212 being elongated has a middle section 22 and two side sections 25 configured at both sides of the middle section 22.

Figure 4:
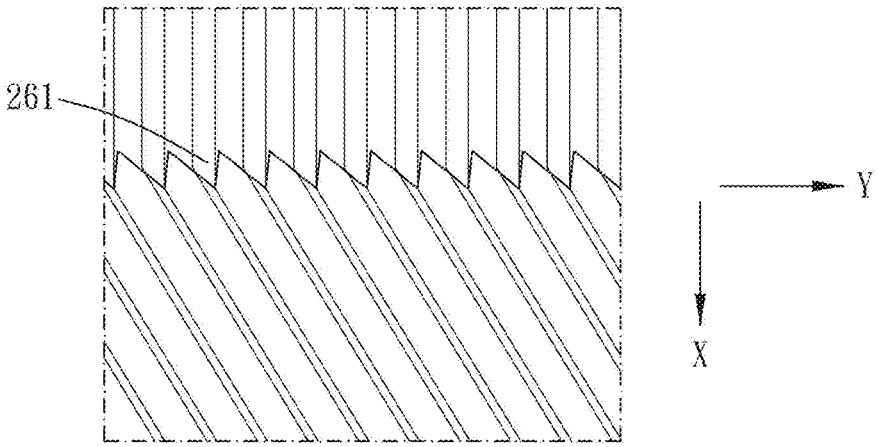
FIG. 4 is a schematic diagram showing the light guide of the microstructure of the light emitting surface of FIG. 1.

Please refer to FIG. 1-FIG. 4, the instant disclosure provides an embodiment, the side sections 25 have a plurality of jagged protrusions 261 forming a light guiding area 26, the cross-section of each jagged protrusion 261 being triangular (as show in FIG. 3 and FIG. 4), the extending direction (z-direction) of the jagged protrusions 261 being vertical to the light emitting direction (x-direction), the jagged protrusions 261 having an inclined light emitting surface 261A, a plurality of the jagged protrusions 261 being arrayed along the light emitting surface 212 forming a continuous and inclined V-shaped grooves (as shown in FIG. 4), which enables the light from the light guide to emit to outside, thereby enlarging the width of the beam contour. Please also refer to FIG. 14, the light from the light source module 10 passes through the light guide structure with jagged protrusions forming the irradiation area, the jagged protrusions 261 of the light guiding area 26 extending the width of the irradiation area on both sides. Further, each of the side sections 25 is average ⅓ of the length in a longitudinal direction of the light emitting surface 212, the beam contour being enlarged evenly in a horizontal direction.

Figure 5:
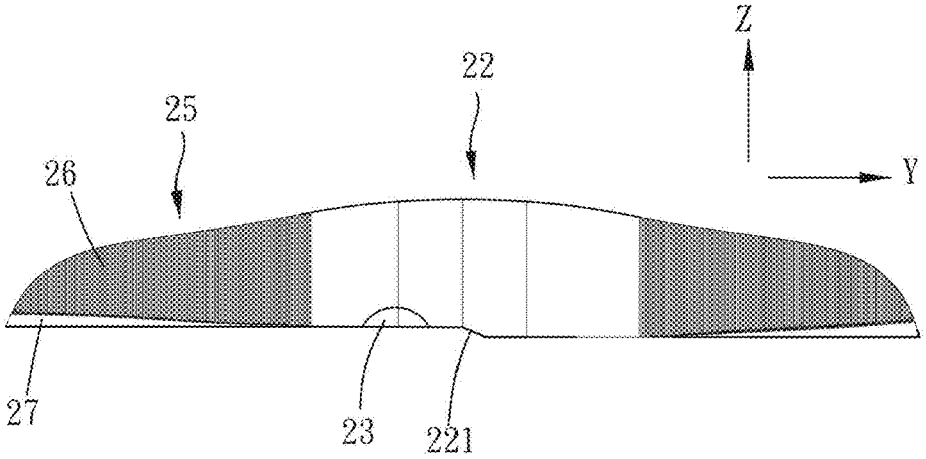
FIG. 5 is a front view showing another embodiment of the light guide structure with jagged protrusions.

Please refer to FIG. 5. the instant disclosure provides an embodiment, the side sections 25 have a smooth area 27 neighboring the lower contour and at least one light guiding area 26 neighboring the upper contour. Please also refer to FIG. 2, the jagged protrusions 261 has a cutting angle 262 tiled from the top to bottom (lower contour) outwardly forming a cutting face, the cutting face formed by the cutting angle 262 of the jagged protrusions 261 being continuous with a side face of the smooth area 27 to adjust the light/dark border generated by the lower contour or adjust into corresponding beam contours.

Figure 1:
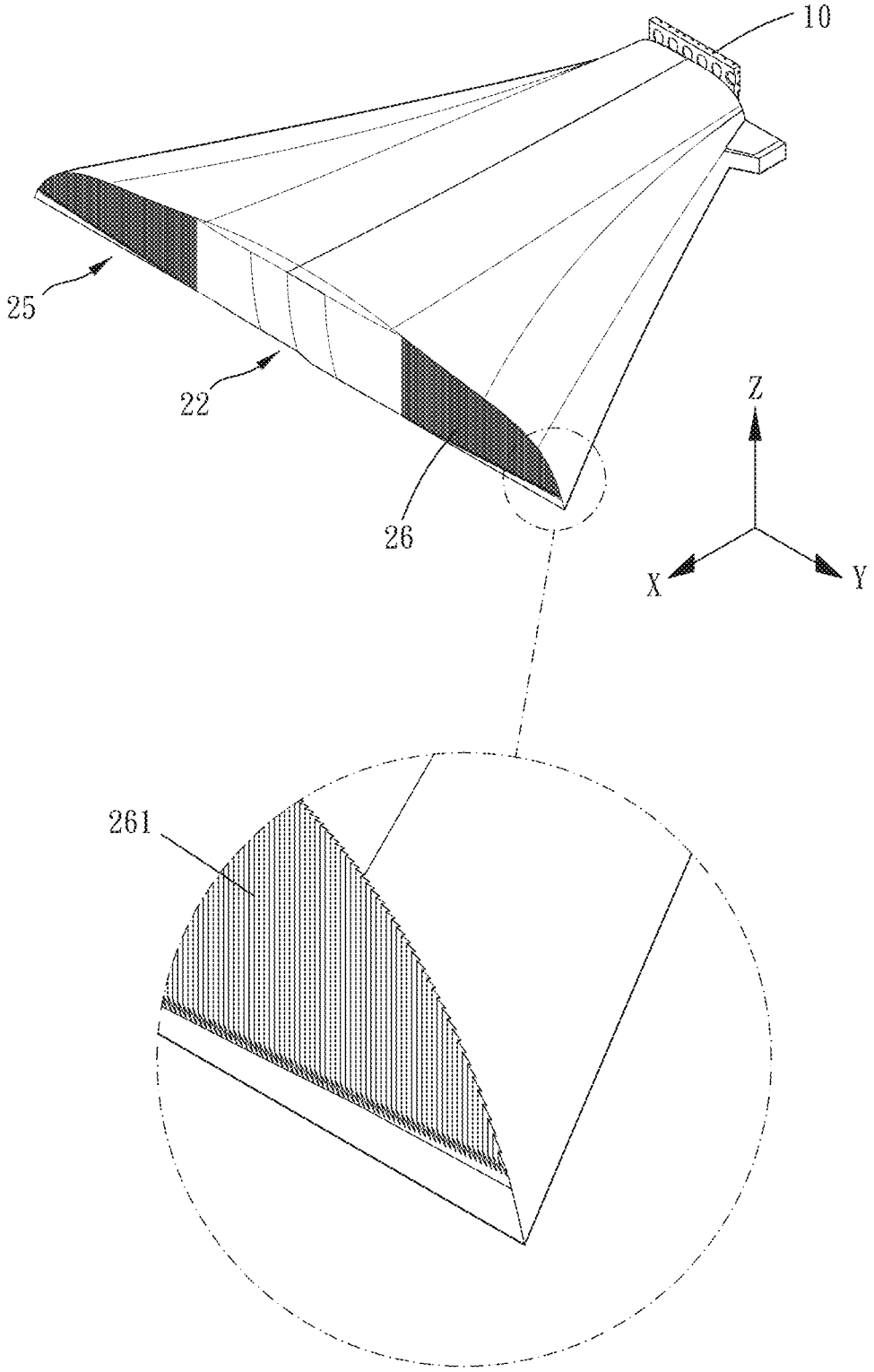
FIG. 1 is an external view of an embodiment showing the light guide structure with jagged protrusions, and a partial enlarged view of the microstructure of the light emitting surface thereof.
Figure 2:
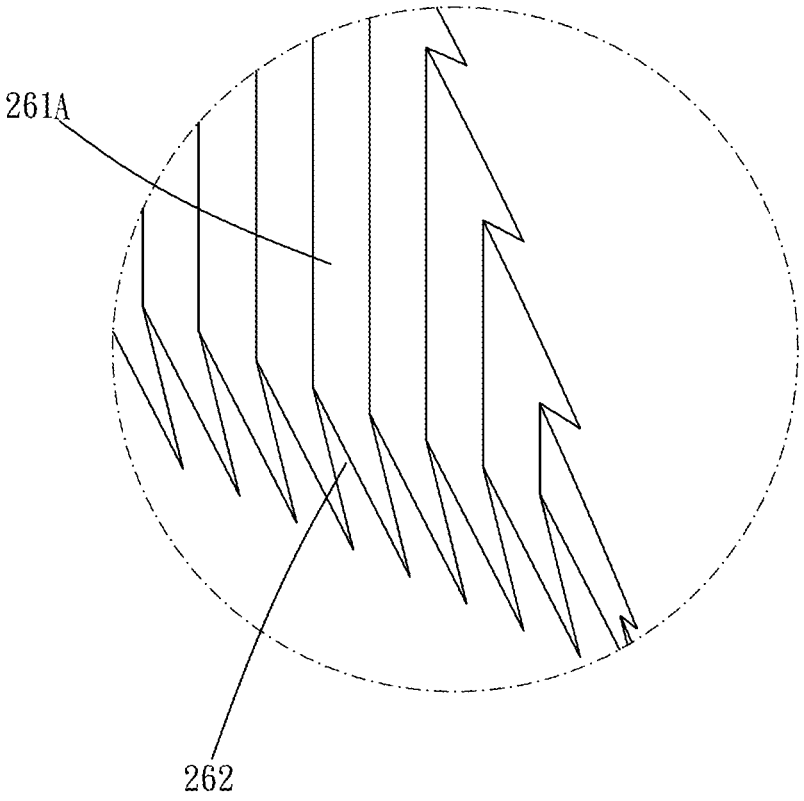
FIG. 2 is another partial enlarged view showing the microstructure of the light emitting surface of FIG. 1.
Figure 3:
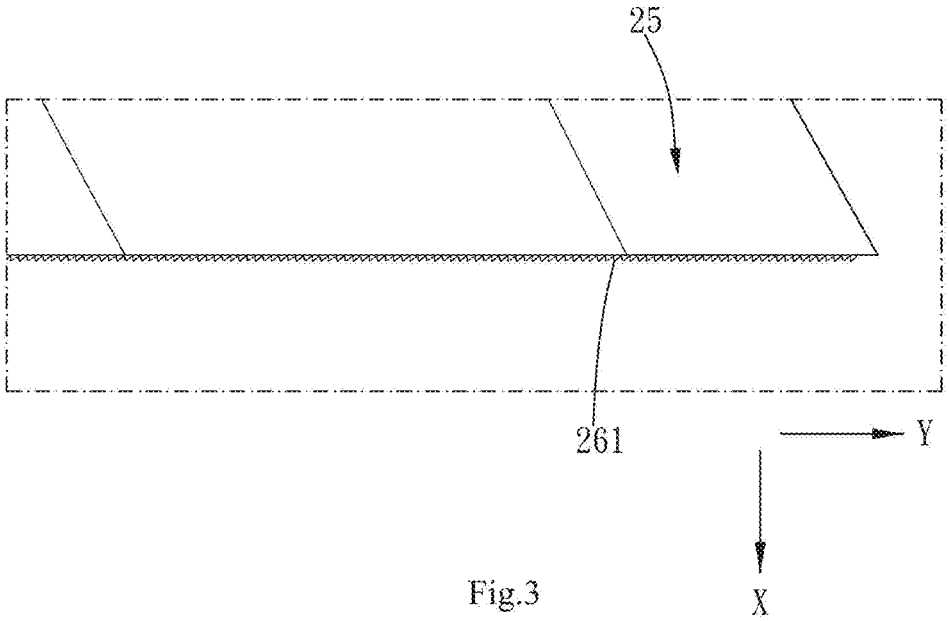
FIG. 3 is a cross-sectional view showing the microstructure of the light emitting surface of FIG. 1.
Figure 13:
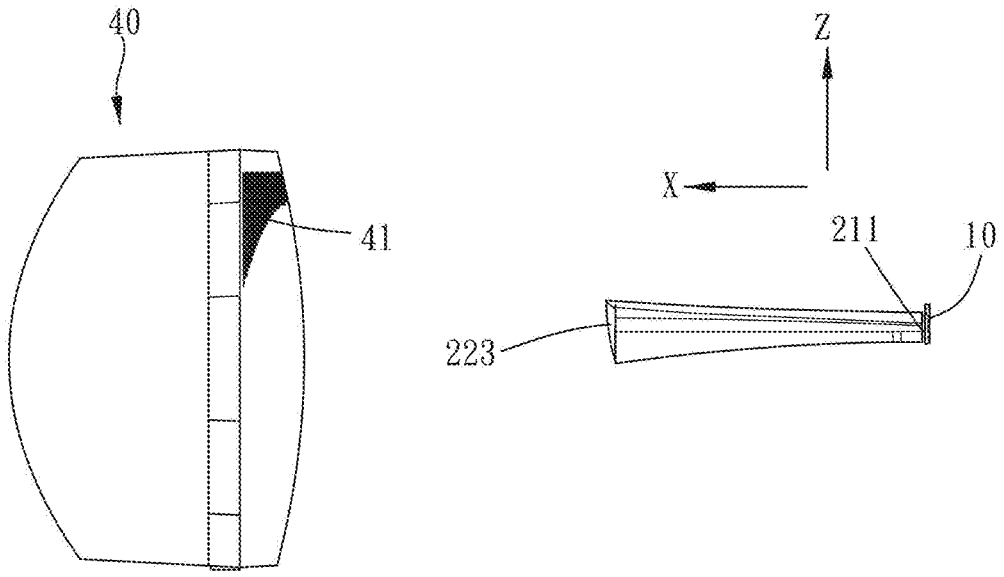
FIG. 13 is a side view showing a headlight structure.
Figure 15:
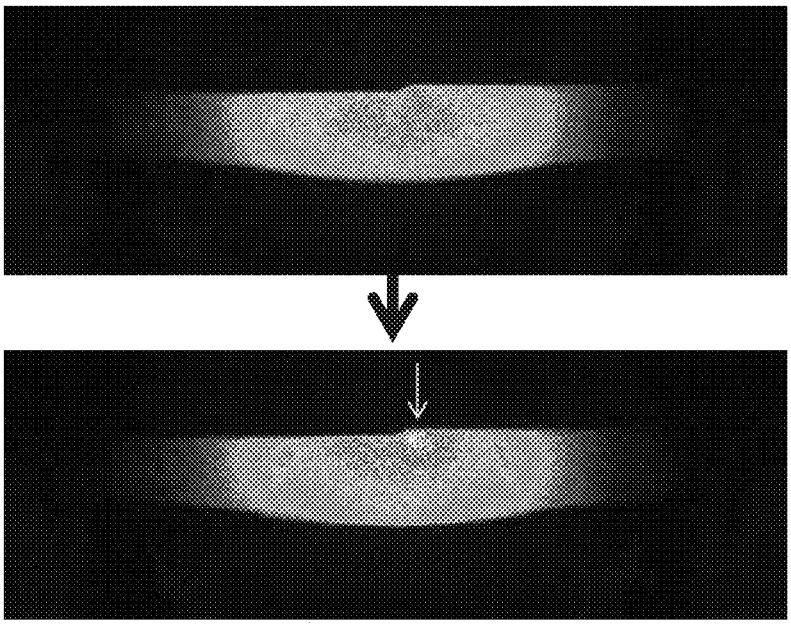

Please refer to FIG. 1 and FIG. 13, the middle section 22 of the light emitting surface 212 of the light guide structure with jagged protrusions protrudes toward the light emitting direction forming a convex surface 223 generating a beam contour shown by an arrow in the lower section of FIG. 15, the middle section 22 corresponding to the irradiation area, partial luminance of the irradiation area being increased by a spotlight (the color is white).

Figure 6:
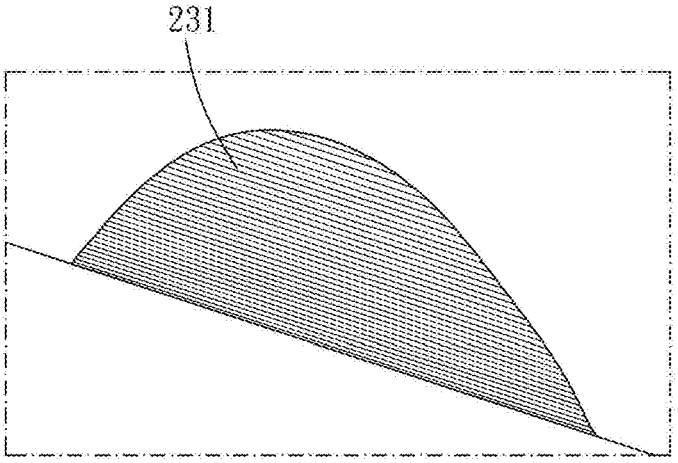
FIG. 6 is a partial enlarged view showing the microstructure of the light emitting surface of FIG. 5.
Figure 7:
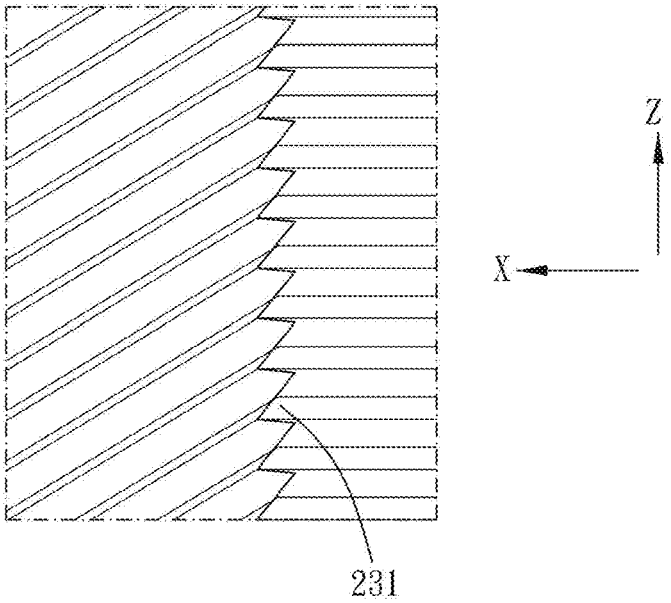
FIG. 7 is a schematic diagram showing the light guide of the microstructure of the light emitting surface of FIG. 5.
Figure 16:
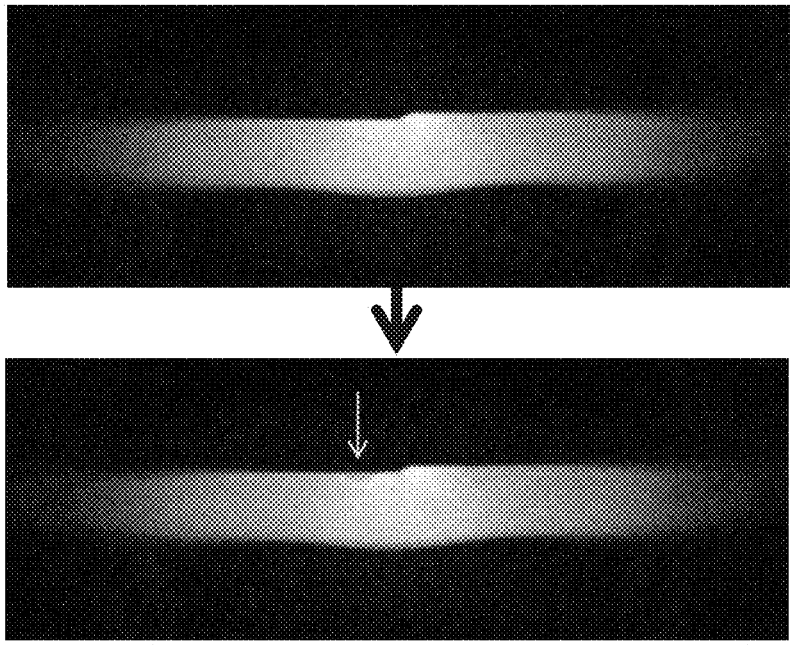
FIG. 16 is a diagram showing the result of the irradiation area deploying the light guide structure with jagged protrusions of FIG. 5.

Please refer to FIG. 5 to FIG. 7, the instant disclosure provides an embodiment, the light emitting surface 212 having the middle section 22 provided with a light guiding area 23 neighboring the cutoff contour 221, the light guiding area 23 having a plurality of dentate protrusions 231 provided with sloped light emitting surface being deployed to change the angle of light instead of directly emitting to the front (x-direction), the area of the beam contour being partially astigmatic, generating a notch shown by an arrow in the lower section of FIG. 16. The light guiding area 23 reduces luminance (generated by the convex surface 223), and prevents the luminance of the irradiation area of the cutoff contour 221 from being too high, which may affect the vision of the oncoming driver. Specifically, the cross section of the dentate protrusions 231 of the light guiding area 23 is identical (being triangular) to or different from the jagged protrusions 261, the extending direction of the dentate protrusions 231 is identical to or intersects with the extending direction of the jagged protrusions 261.

In addition, the microstructure of the light guiding area 23 is configured to enable the light from the light guide to emit through the light emitting surface 212 generating refraction, diffusion, or scattering, for example, the microstructure of the light guiding area 23 is a plurality of dot plane contours, a plurality of round convex points, a plurality of polygonal plane contours, or a plurality of polygonal convex points, or a matrix structure similar to the light guiding microstructure 41, 42 described below having a similar effect.

Figure 8:
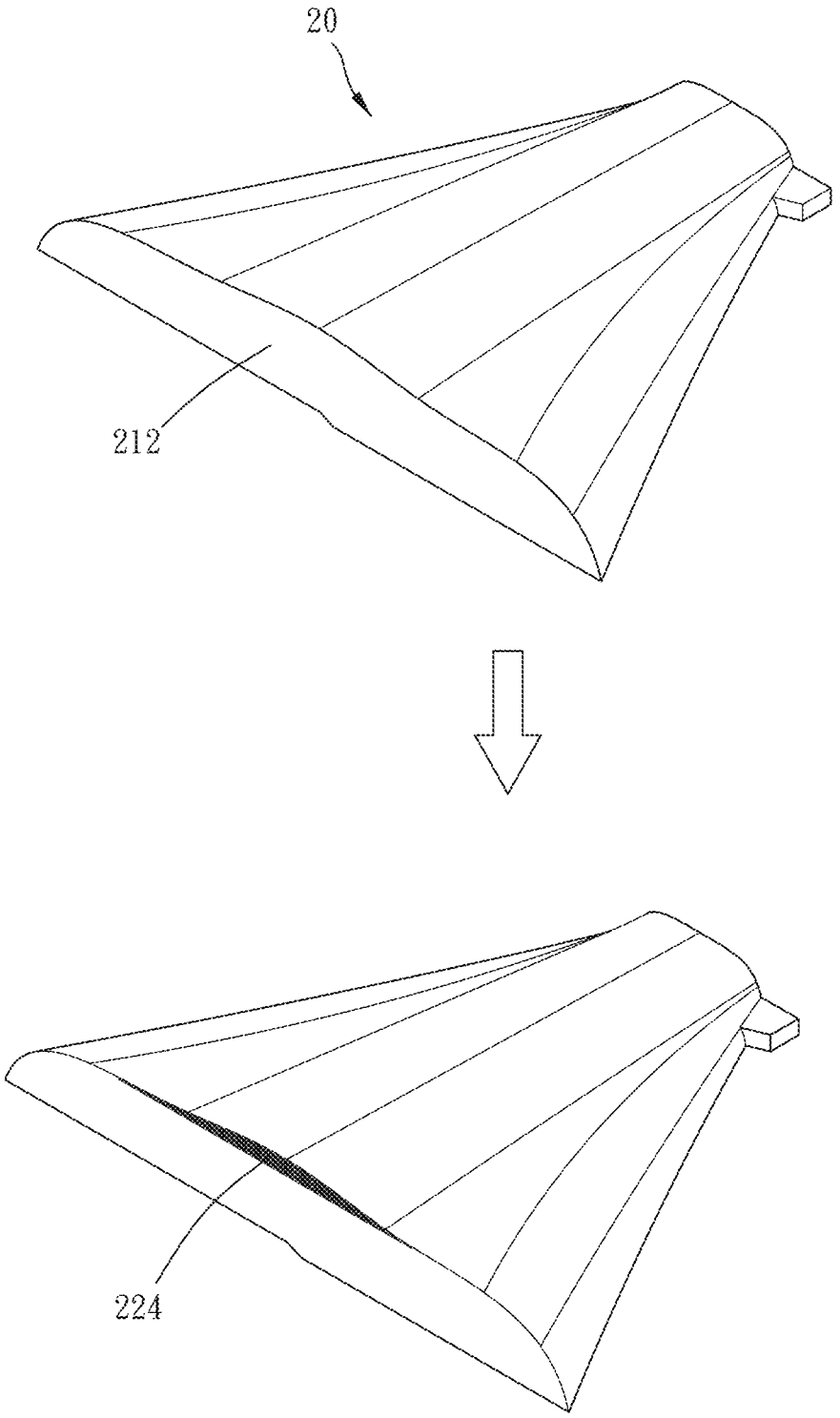
FIG. 8 is a schematic diagram showing another embodiment of the light guide structure with jagged protrusions.
Figure 9:
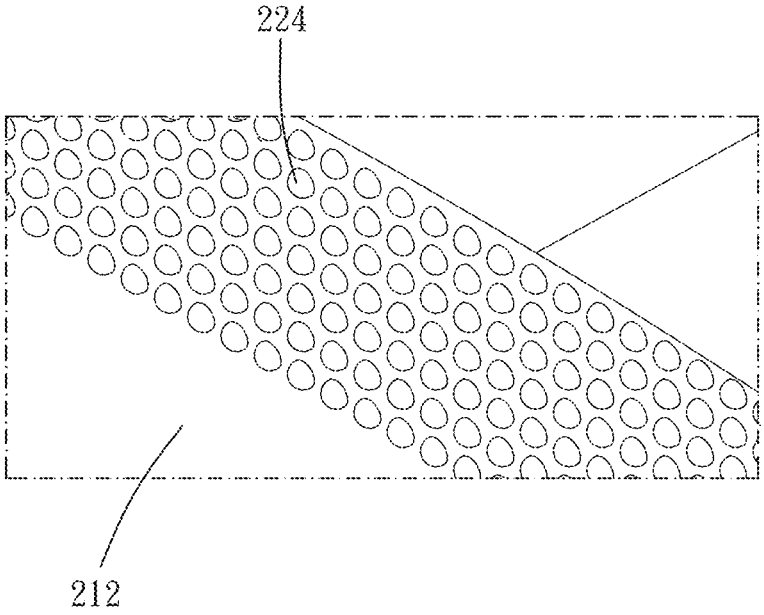
FIG. 9 is a partial enlarged view showing the microstructure of the light emitting surface of FIG. 8.
Figure 17:
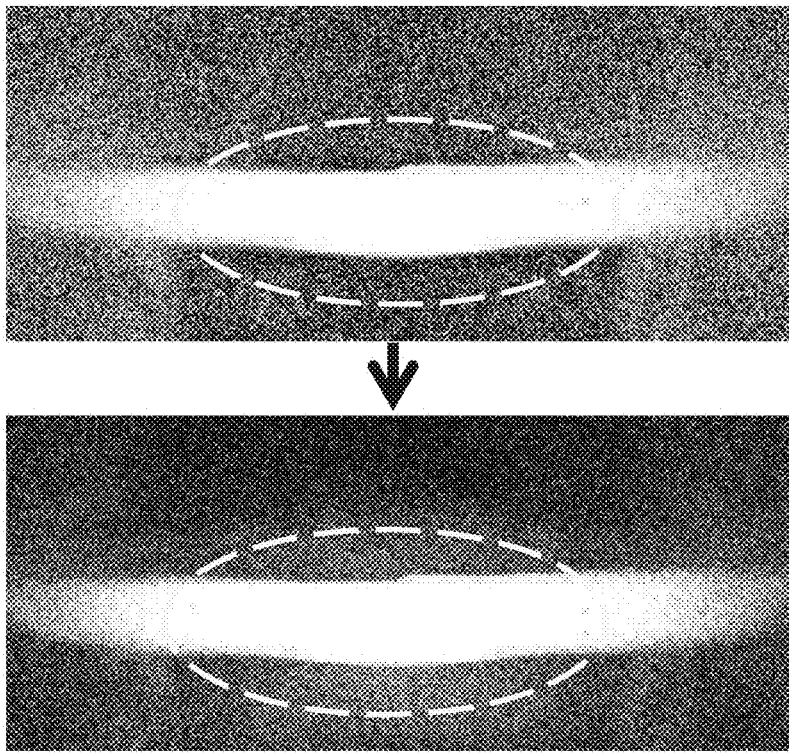
FIG. 17 is a diagram showing the result of the irradiation area deploying the headlight structure of FIG. 12.

Please refer to FIG. 8 and FIG. 9, the instant disclosure provides an embodiment showing the light emitting surface of the light guide structure with jagged protrusions, the light emitting surface 212 of the light guide structure with jagged protrusions being roughly planar (for example, shown in the upper section of FIG. 11), the light emitting surface 212 forming another elongated light guiding area arranged in the middle section of an arc contour of the upper contour of the light emitting surface 212. The light guiding microstructure 224 of the light guiding area comprises a plurality of round convex points forming a matrix, generating the beam contour shown in the lower section of FIG. 17, improving the Blue field entoptic phenomenon of the beam contour.

The formation of the Blue field entoptic phenomenon is due to the use of white light LEDs as a light source. This type of LED is usually a mixture of LED blue light and phosphor yellow light. Because blue light has characteristics of short wavelength and large refraction angle, the edge of the beam contour is prone to generate blue lines. When driving, the blue lines generated by the beam contour easily affects the vision of the oncoming driver and generates afterimages. Therefore, improving the Blue field entoptic phenomenon ensures driving safety.

Figure 10:
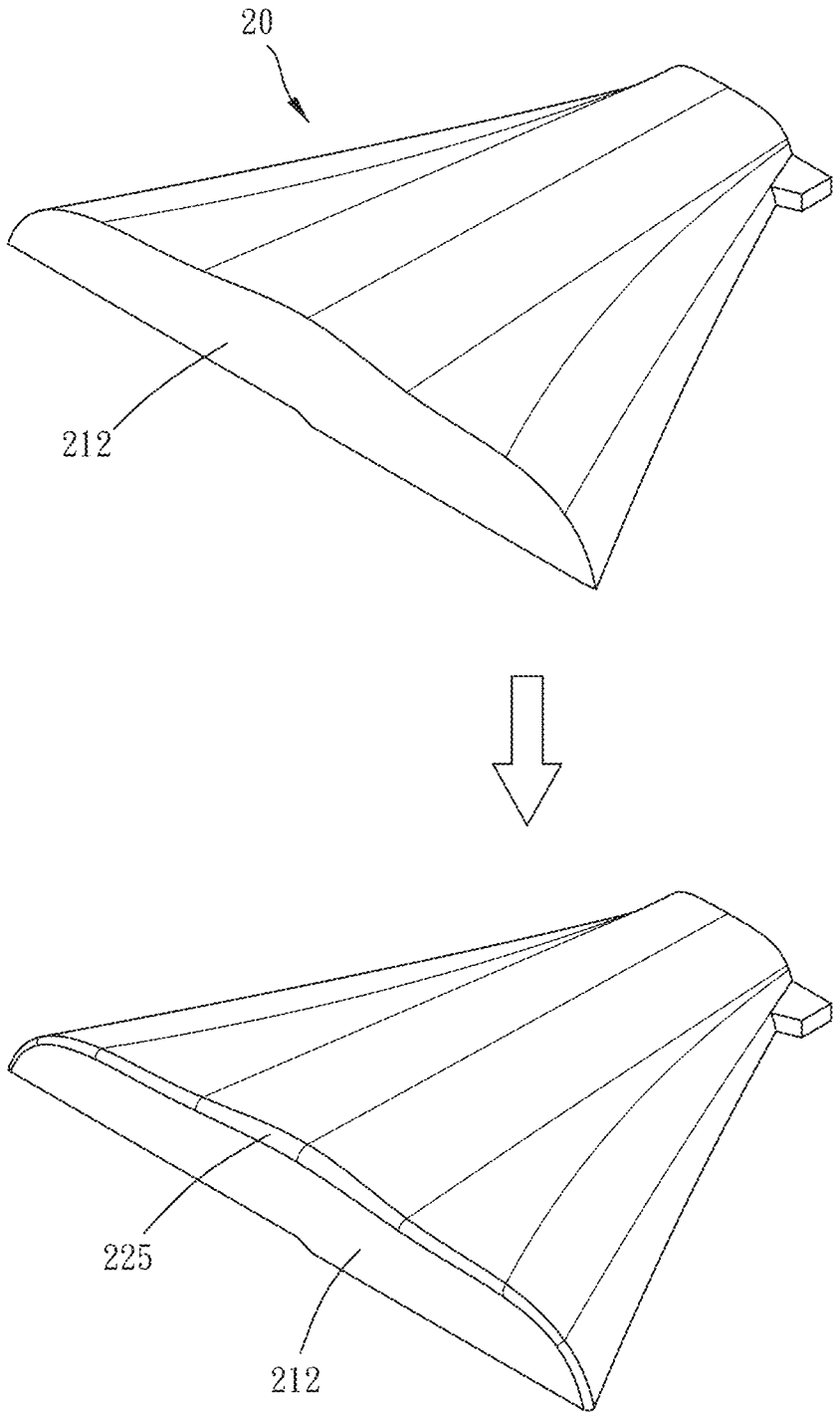
FIG. 10 is a schematic diagram showing another embodiment of the light guide structure with jagged protrusions.
Figure 11:
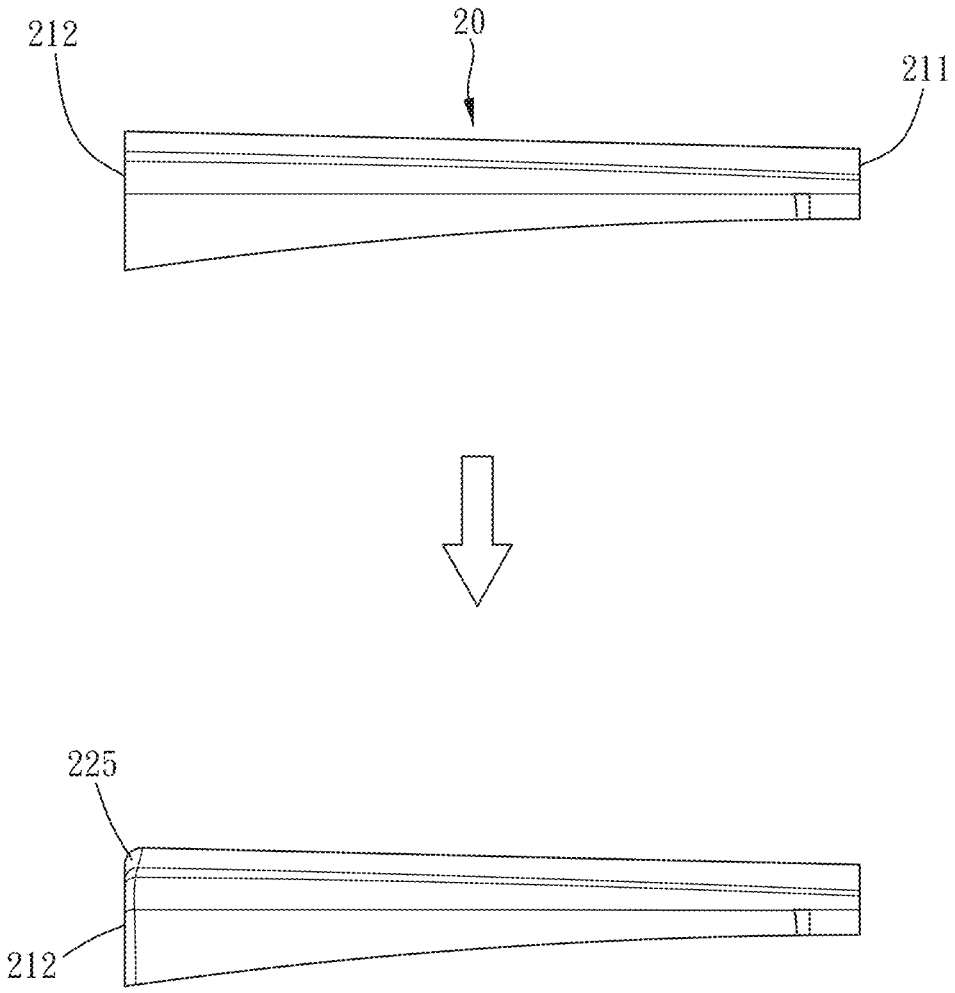
FIG. 11 is a side view of the light guide structure of FIG. 10.

Please refer to FIG. 10 and FIG. 11, the instant disclosure provides an embodiment showing the light emitting surface of the light guide structure with jagged protrusions, the planar light emitting surface 212 being configured to improve Blue field entoptic phenomenon, the upper contour of the light emitting surface 212 of the light guide structure with jagged protrusions being provided with a round angle formed along the edge of the arc contour, an elongated light guiding contour 225 being formed on the upper contour of the light guide structure with jagged protrusions. The light guide structure enables the light to emit from the upper contour generating refraction, diffusion, or scattering, generating the beam contour shown in the lower section of FIG. 17. Optionally, at least a part of the edge of the arc contour of the light emitting surface is configured with a round angle, the corresponding position provided with the above-mentioned light guiding contour 225, generating a similar effect.

Figure 14:
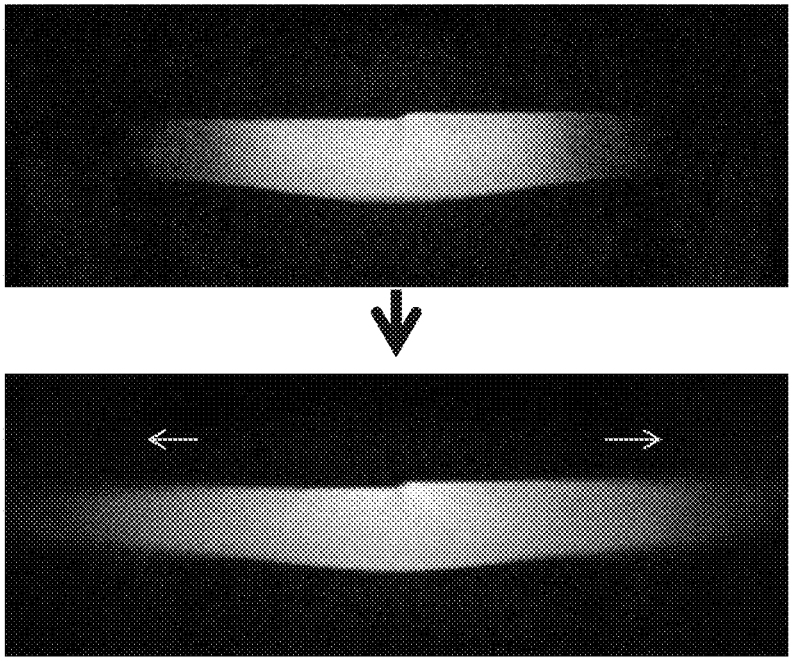
FIGS. 14 and 15 are diagrams showing the results of the irradiation area deploying the light guide structure with jagged protrusions of FIG. 1.

Please refer to FIG. 13 and FIG. 14, the instant disclosure provides an embodiment showing a headlight structure, the light source module 10 comprising a light guide 20 and a lenticular lens 40 sequentially configured in the light emitting direction, the light guide 20 being formed into the aforementioned light guide structure, the light emitting surface 212 of the light guide 20 defining the beam contour and the irradiation area, the light emitting surface 212 having at least a plurality of the jagged protrusions 261 configured on the side sections 25 of the light emitting surface 212, and the extending direction of the jagged protrusions 261 intersects with light emitting direction.

In the light emitting direction, the lenticular lens 40 roughly forms a rectangular contour, the lenticular lens 40 having a plurality of light guiding microstructures 41, 42 arrayed in a matrix, the light guiding microstructures being configured along at least the edge of the corresponding beam contour in the light emitting direction. The edge refers to the light/dark border near the irradiation area, but not limited to this, the light guiding microstructures capable of adjusting the beam contour on any position of the lenticular lens 40 respectively, hereby generating the beam contour shown in the lower section of FIG. 17 to improve Blue field entoptic phenomenon.

The instant disclosure provides an embodiment, the light guiding microstructures 41, 42 form a plurality of light guiding areas on the light injecting surface of the lenticular lens 40. When approaching the short side of the lenticular lens 40 (that is, corresponding to the beam contour of the side sections 25 of the modified light guide 20), the light guiding microstructure 41 is a square matrix. When approaching the middle section of the lenticular lens 40 (that is, corresponding to the beam contour of the middle section 22 of the light guide 20), the light guiding microstructure 42 is a circular matrix. Other parts of the light guiding microstructures are gradually changed from a square to a circle from the short side to the middle section of the lenticular lens 40, improving the damage to the vision of the oncoming driver caused by the Blue field entoptic phenomenon.

In some embodiments, the lens 40 is any lens that generates a spotlight effect, such as a plano-convex lens.

What is claimed is:

1. A light guide structure with jagged protrusions configured in a lighting device of a mobile vehicle, comprising:

a light injecting surface; and a light emitting surface, wherein the light emitting surface is elongated in a longitudinal direction, wherein the light emitting surface is provided with a side section, a middle section, and another side section spaced apart from the side section along the longitudinal direction, wherein the side sections have a smooth area and at least a light guiding area, wherein the jagged protrusions are configured in the light guiding area, wherein each of the jagged protrusions has an inclined light emitting surface, which enables the light from the light guide to emit to outside and enlarge the width of a beam contour, wherein the jagged protrusions have a cutting face formed by a cutting angle tilted from top to bottom outwardly, the cutting face is continuous with a side face of the smooth area, wherein an extending direction of the jagged protrusions intersects with a light emitting direction.

2. The light guide structure with jagged protrusions of claim 1, wherein the extending direction of the jagged protrusions is vertical to the light emitting direction.

3. The light guide structure with jagged protrusions of claim 1, wherein each of the side sections is ⅓ the length of the light emitting surface in the longitudinal direction.

4. The light guide structure with jagged protrusions of claim 1, wherein the light emitting surface has a contour, wherein the contour comprises an arc contour and a lower contour, wherein the lower contour has two bevels forming a cutoff contour, wherein the light emitting surface has a light guiding area neighboring or configured in at least a part of the contour.

5. The light guide structure with jagged protrusions of claim 4, wherein the light guiding area is neighboring or configured in the middle section of the arc contour.

6. The light guide structure with jagged protrusions of claim 4, wherein the light guiding area is neighboring the cutoff contour, wherein the light guiding area has a plurality of dentate protrusions, wherein an extending direction of the dentate protrusions intersects with an extending direction of the jagged protrusions.

7. The light guide structure with jagged protrusions of claim 4, wherein the light emitting surface has the middle section, wherein the middle section has the light guiding area, wherein the light guiding area is formed to enable the light to generate a refraction, a diffusion or a scattering in the light emitting direction.

8. The light guide structure with jagged protrusions of claim 4, wherein the light emitting surface has the arc contour, wherein at least a part of an edge of the arc contour forms a fillet, wherein the fillet forms an elongated light guiding area.

9. The light guide structure with jagged protrusions of claim 1, wherein the light emitting surface has the middle section protruding toward the light emitting direction.

10. The light guide structure with jagged protrusions of claim 1, wherein the entire middle section is free from jagged protrusions.

11. The light guide structure with jagged protrusions of claim 1, wherein the entire middle section is a smooth surface.

12. A light guide structure with jagged protrusions configured in a lighting device of a mobile vehicle, comprising:

a light injecting surface; and a light emitting surface, wherein the light emitting surface is elongated, wherein the light emitting surface comprises a middle section and two side sections deployed respectively at opposite left end and right end of the middle section, wherein the side sections have a smooth area and at least a light guiding area, wherein the jagged protrusions are configured in the light guiding area, wherein the jagged protrusions have an inclined light emitting surface, wherein the jagged protrusions have a cutting face formed by a cutting angle tilted from top to bottom outwardly, the cutting face is continuous with a side face of the smooth area, wherein an extending direction of the jagged protrusions intersects with a light emitting direction, wherein two ends of the jagged protrusions at a junction of the middle section and one of the side sections are extending entirely from the upper edge of the contour of the light emitting surface to the lower edge of the contour of the light emitting surface, and wherein the smooth area and the middle section are separated from each other by the jagged protrusions.

* * * * *